US007562494B2

(12) United States Patent
Platts

(10) Patent No.: US 7,562,494 B2
(45) Date of Patent: Jul. 21, 2009

(54) RETROFITTING APPARATUS AND METHOD FOR SECURING ROOF FRAMES AGAINST WINDS

(76) Inventor: Robert E. Platts, 12 Bedford Crescent, Ottawa, Ontario (CA) K1K 0E4

( * ) Notice: Subject to any disclaimer, the term of this patent is extended or adjusted under 35 U.S.C. 154(b) by 468 days.

(21) Appl. No.: 11/116,226

(22) Filed: Apr. 28, 2005

(65) Prior Publication Data

US 2006/0254193 A1 Nov. 16, 2006

(51) Int. Cl.
*E04B 7/00* (2006.01)

(52) U.S. Cl. ..... 52/23; 52/92.2; 52/148; 52/167.3; 52/DIG. 11

(58) Field of Classification Search ..... 52/23, 52/92.1, 148, 90.1, 167.3, DIG. 11, 92.2, 52/150, 151, 293.3
See application file for complete search history.

(56) References Cited

U.S. PATENT DOCUMENTS 1,864,403 A * 6/1932 Bradley ..... 403/213
4,079,556 A * 3/1978 Luck et al. ..... 52/127.2
4,288,951 A * 9/1981 Carlson et al. ..... 52/94
4,714,372 A 12/1987 Commins
5,257,483 A 11/1993 Netek
5,311,708 A 5/1994 Frye
5,319,896 A * 6/1994 Winger ..... 52/23
5,388,378 A * 2/1995 Frye ..... 52/23
5,560,156 A 10/1996 McDonald
5,687,512 A * 11/1997 Spoozak et al. ..... 52/23
5,983,572 A * 11/1999 Laboy ..... 52/23
6,094,880 A 8/2000 Thompson
6,247,276 B1 * 6/2001 Masters et al. ..... 52/169.12
6,343,449 B1 * 2/2002 MacKarvich ..... 52/293.3
6,481,165 B1 * 11/2002 Romary et al. ..... 52/122.1
6,725,613 B2 * 4/2004 Oliver et al. ..... 52/169.9
6,763,634 B1 7/2004 Thompson
6,843,027 B2 * 1/2005 Gaddie et al. ..... 52/92.1
6,865,852 B2 * 3/2005 Gower ..... 52/222

OTHER PUBLICATIONS

Simpson Strong-Tie Wood Construction Connectors Catalogue C2005 (Internet address: http://www.strongtie.com).

* cited by examiner

*Primary Examiner*—Richard E Chilcot, Jr.
*Assistant Examiner*—Chi Q Nguyen
(74) *Attorney, Agent, or Firm*—Ogilvy Renault LLP

(57) ABSTRACT

An apparatus and method is provided for tying down an existing roof frame to resist windstorm uplift forces, in which an elongate connector is inserted slantingly upward through a hole through the roof frame, allowing an upper end of the connector to protrude from the roof frame to receive a head member which is detachably attached thereto in order to prevent the roof frame from moving upward relative to the connector under an uplift force. The lower end of the connector is secured to an underlying wall such that the connector applies a restraining force against wind uplift forces.

13 Claims, 4 Drawing Sheets

RETROFITTING APPARATUS AND METHOD FOR SECURING ROOF FRAMES AGAINST WINDS

TECHNICAL FIELD

The present invention relates to reinforcement of wood roof structures of houses and low-rise buildings, and more particularly to a retrofitting apparatus and method for securing wood roof frames against winds.

BACKGROUND OF THE INVENTION

Many millions of houses and small buildings are located in hurricane or tornado areas in, for example, the United States, at high risk of damage from the strong winds of hurricanes or tornadoes. Recent studies of hurricane damage indicate that the most extensive damage to a house occurs when the roof is torn off, allowing the rain which often accompanies strong winds to ruin the contents of the house, and often allowing walls to collapse.

There is a great need for affordable retrofitting methods for reinforcement of wood roof frames. While prior art connectors of steel strip tie-down types excel as affordable connectors of roof structures to underlying walls in new construction of houses and small buildings, they are not as applicable when retrofitting existing roof frame structures. These fittings pose difficulties in retrofitting applications because an upper portion of the steel-strip tie must extend over the top of a rafter/truss and down the other side in order to ensure adequate tie-down strength by applying the restraining force mainly at the top of the roof frame, as compression across the grain, which wood withstands quite well. If the tie-down connectors are simply nailed into the side of the rafter/truss, as commonly done in the prior art, localized tensions are induced across the grain of the wood such that the rafter/truss member tends to split under high uplift conditions, which can release the connector's nails.

The over-the-top method is now widely recommended or required in the "Hurricane Belt" of the United States, even for retrofits of existing buildings. During retrofitting however, accessing the top portion of the rafter/truss requires removal and later restoration of an area of roofing and sheathing, which are laborious and costly operations, and thus tend to discourage such retrofit upgrading of the existing housing and building stock.

Prior art efforts to devise retrofits for reinforcement of roof structures have also been made. A number of United States patents as examples of such efforts are briefly discussed below.

In U.S. Pat. No. 5,257,483 (Netek) discloses some of the complications of retrofitting by installing anchor points in fascia and the wall below, allowing temporary placement of ties in the face of an impending storm. Winger, in U.S. Pat. No. 5,319,816, and several other inventors, disclose various temporary arrangements of multiple cables or nets over the roof which are anchored to the ground. Such temporary devices demand that the householder be at home through the hurricane season, ready to react to storm warnings quickly and competently.

In U.S. Pat. No. 5,311,708, Frye shows a retrofit roof tie-down method in which lag screws are installed upwardly through a steel angle into the lower edges of the rafter/trusses, a lower leg of the steel angle being lag-screwed into the underlying wall. Frye's lag screws into the narrow edge of the rafter/truss would however invite splitting and cause tension failure. Furthermore, only the screws near the junction of rafter/trusses with the top of the wall would contribute effectively, and the usual absence of a stud directly under a rafter/truss would leave Frye's wall lag screws rather ineffective.

Thompson, in U.S. Pat. No. 6,763,634, tries to resolve the retrofit problem by inserting ties down through the roofing and sheathing from above, with one strip on each side of the rafter/truss to form a saddle across it, which is able to effectively hold down the roofing and sheathing together with the rafter/truss. Thompson's ties extend down to connect to the underlying wall below. All this entails laborious and uncertain sealing of the roof penetrations, and interferes with any subsequent re-roofing job.

Therefore, there is a need for improved retrofitting methods for reinforcement of roof frames structures.

SUMMARY OF THE INVENTION

One object of the present invention is to provide a retrofitting method and apparatus for reinforcement of roof frame structures against winds.

In accordance with one aspect of the present invention, there is an apparatus for reinforcement of an existing roof frame structure frame structure which comprises an elongate connector having an upper portion adapted to extend slantingly upward through a hole through a roof frame, allowing an upper end of the connector to protrude from a first side of the roof frame near a top edge thereof, and allowing a lower portion of the connector to extend downwardly from a second side of the roof frame such that a lower end of the connector can be secured to an underlying supporting structure. A head member is detachably connected to the upper end of the connector in order to prevent the roof frame from moving upward relative to the connector under an uplift force.

In accordance with another aspect of the present invention, there is a method provided for reinforcement of an existing roof frame structure which comprises steps of (a) making a hole which extends slantingly upward through a roof frame under a roof sheathing panel from a second side to a first side of the roof frame; (b) inserting an upper portion of an elongate connector through the hole from the second side to the first side of the roof frame until an upper end of the connector protrudes from the first side thereof; (c) attaching a head member to the upper end of the connector in order to prevent the roof frame from moving upward relative to the connector under an uplift force; and (d) securing a lower end of the connector to an underlying wall.

In accordance with a further aspect of the present invention, there is a reinforcement structure for roof frame retrofitting which comprises an elongate connector having an upper portion extending slantingly upward through a hole through a roof frame under a roof sheathing panel and a lower portion extending downwardly from a second side of the roof frame. The upper portion of the connector includes an upper end thereof protruding from a first side of the roof frame near a top edge of the roof frame. The lower portion of the connector includes a lower end thereof secured to an underlying wall. A head member is detachably connected to the upper end of the connector to prevent the roof frame from moving upward relative to the connector under an uplift force.

Other features and advantages of the present invention will be better understood with reference to the preferred embodiments described hereinafter.

BRIEF DESCRIPTION OF THE DRAWINGS

Reference will now be made to the accompanying drawings showing by way of illustration the preferred embodiments of the present invention, in which.

DETAILED DESCRIPTION OF THE PREFERRED EMBODIMENTS

Figure 1:
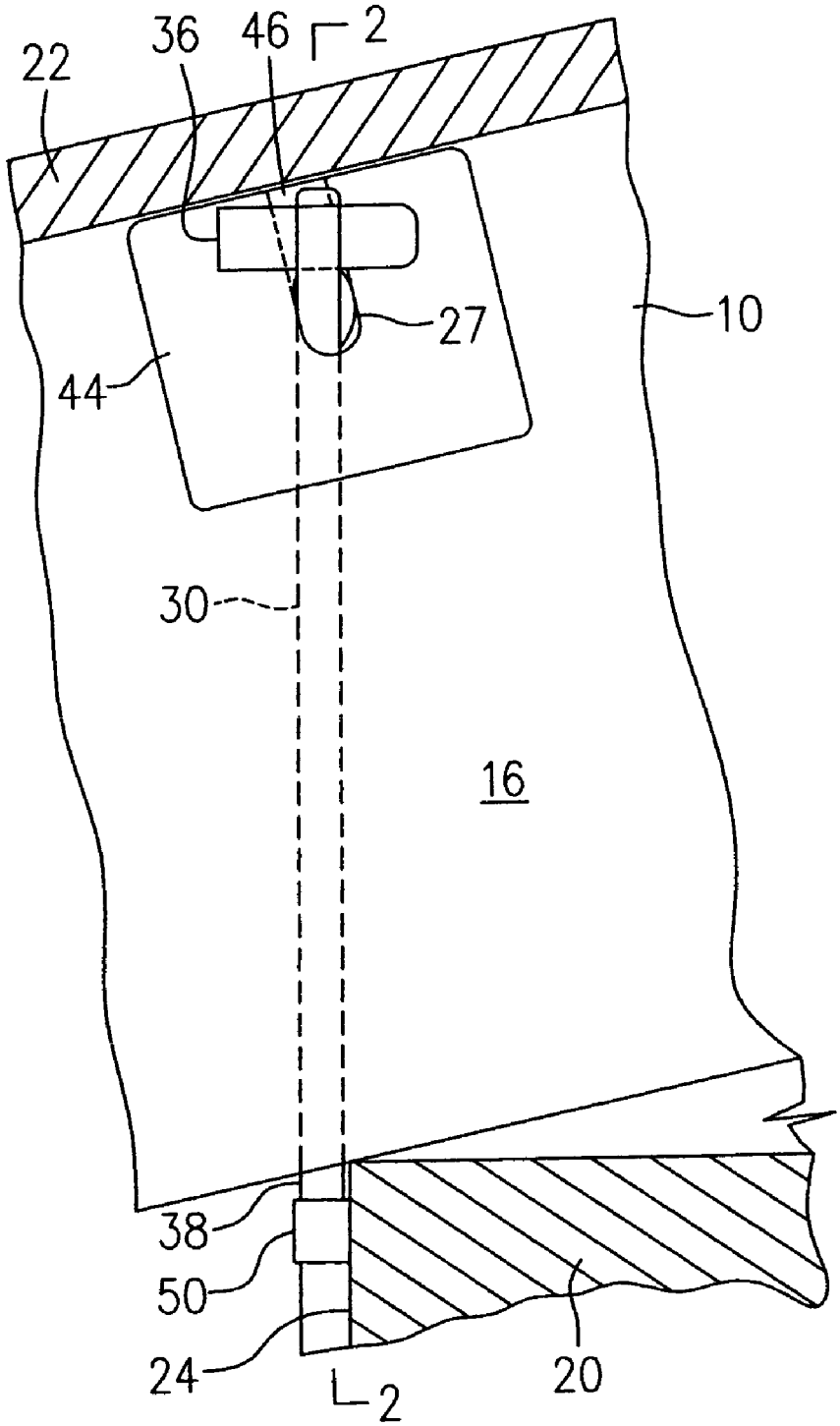
FIG. 1 is a partial elevational side view of a roof structure incorporating a slant toggle connector for reinforcement of the roof structure in accordance with one embodiment of the present invention.
Figure 2:
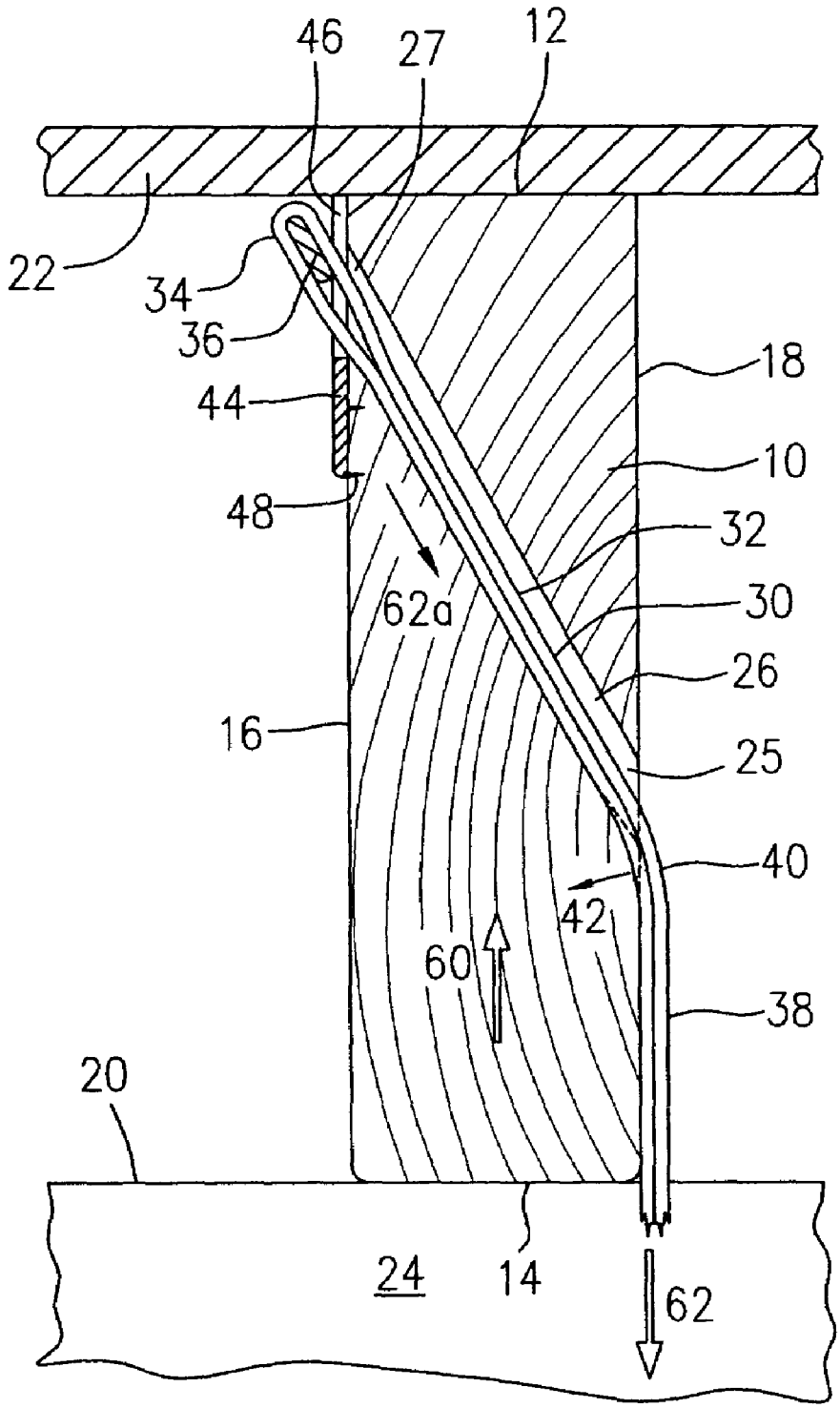
FIG. 2 is a cross-sectional view of the roof structure taken along line 2-2 in FIG. 1, showing the slant toggle connector extending across a roof frame of the roof frame structure.

FIGS. 1 and 2 illustrate an existing wood roof frame structure incorporating one embodiment of the present invention for reinforcement of the existing roof frame structure in a retrofit job. In a wood roof frame structure, rafters and trusses are roof structural members and usually present similar rectangular cross sections. Rafters and trusses generally extend partially or wholly between exterior walls and provide locations for reinforcing the structure where rafters and trusses cross over such walls. In order to denote a roof structural member without the need for unnecessary distinction between rafters and trusses, such roof structural members are referred to as a roof frame throughout the text of this specification and the appended claims, and are indicated by numeral 10 in the drawings. The roof frame 10 has two opposed relatively narrow sides referred to as top and bottom edges 12, 14 and two opposed relatively wide sides referred to as first and second sides 16, 18 thereof. The roof frame 10 sits upon a portion of a wall which is generally a load-bearing exterior wall. An underlying wall 20 denotes such a portion of the wall. A roof sheathing panel 22 is attached to the top edge 12 of the roof frame 10 and represents the roof sheathing which ties the roof frames together and supports the roofing material.

An elongate connector preferably referred to as a slant toggle connector 30 according to a preferred embodiment of the present invention has an upper portion 32 extending slantingly upward through a hole 26 through the roof frame 10 from the second side 18 to the first side 16 thereof. An upper end 34 of the slant toggle connector 30 protrudes from the first side 16 of the roof frame 10 and a head member is detachably attached to the upper end of the connector. In this embodiment, the upper end 34 preferably forms a loop (not indicated) for receiving a pin 36 extending therethrough in order to prevent the roof frame 10 from moving upward relative to the slant toggle connector 30 under an uplift force. It is preferable to make the slant toggle connector 30 with a bendable metal bar having, for example, a rectangular cross-section, folded at a middle point thereof such that the upper end 34 thereof is formed into such a loop. The folded metal bar can form the entire slant toggle connector 30, or can form the looped upper end 34 only. Nevertheless, the folded slant toggle connector 30 can be made of other type of metal materials, such as a wire of circular cross-section according to other embodiments.

The slant toggle connector 30 further includes a lower portion 38 extending downwardly from the second side 18 of the roof frame 10, allowing a lower end of the slant toggle connector 30 to be secured to an underlying supporting structure, such as a surface 24 of the underlying wall 20, which will be further described below with reference to FIGS. 3 and 4.

A bend 40 of the slant toggle connector 30 is normally formed between the upper portion 32 and the lower portion 38 thereof at an entry 25 of the hole 26, resulting in a small compressive force represented by an arrow 42, particularly when a pretension is applied to the slant toggle connector 30, and when the roof frame 10 is subject to upward forces.

A first load distribution plate 44 is preferably disposed between the pin 36 held by the loop of the upper end 34 of the slant toggle connector 30 and the first side 16 of the roof frame 10. The distribution plate 44 can be of any shape such as square, as illustrated in FIG. 2, with an opening, for example a slot 46, substantially aligning with an exit 27 of the hole 26 on the first side 16 of the roof frame 10, in order to permit the upper end 34 of the slant toggle connector 30 to extend therethrough.

The load distribution plate 44 further preferably includes a plurality of teeth 48 protruding from one side thereof for penetrating into the roof frame 10, which provides convenience for setting the plate 44 in position and helps minimize slippage of the plate 44 during a force transfer from the pin 36 through the load distribution plate 44 and into the roof frame 10.

Figure 3:
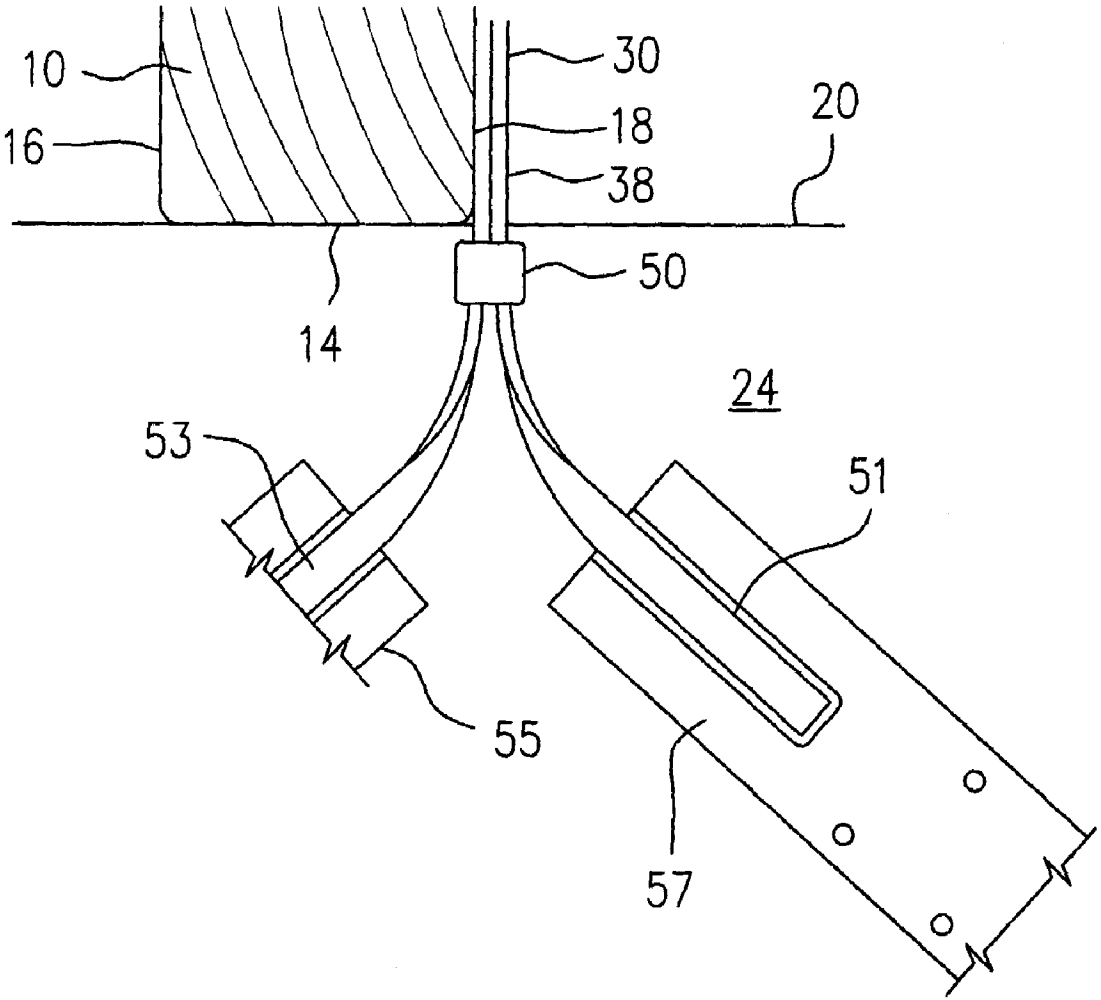
FIG. 3 is a partial cross-sectional view of a lower portion of the roof frame structure, similar to the view of FIG. 2, showing the attachment of a lower portion of the slant toggle connector to the surface of an underlying wall according to one arrangement.

Referring now to FIG. 3, when the slant toggle connector 30 is made of a folded metal bar or wire, a clip member 50 is preferably used to keep the two bar sections of the lower portion 38 together at a location below the bottom edge 14 of the roof frame 10, allowing lower ends 51, 53 of the respective two metal bar sections of the lower portion 38 of the slant toggle connector 30 to extend divergently. Optionally, the clip member 50 can be slidably adjustable to permit selection of a gathering point of the splayed lower ends 51, 53. Metal strips such as steel strips 55, 57 with mounting holes (not indicated) therein, are connected, for example by welding, to the respective lower ends 51, 53 of the slant toggle connector 30 during manufacturing. The divergently extending steel strips 55, 57 spread downwardly across a substantial area of a surface 24 of the underlying wall 20, thereby providing increasing areas for secure anchorage to the surface 24 of the underlying wall 20 by way of nails or screws (not shown).

Figure 4:
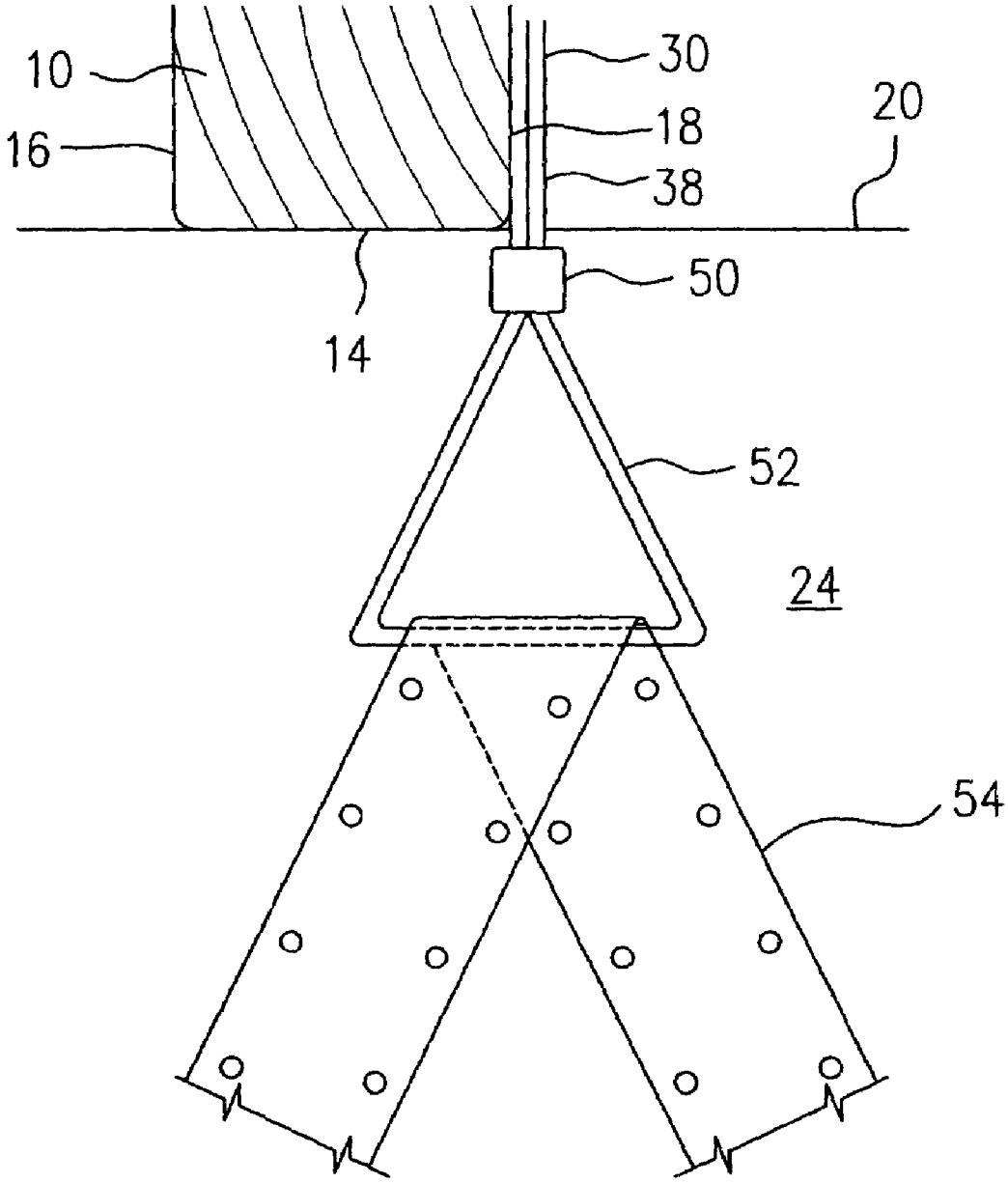
FIG. 4 is a partial cross-sectional view of a lower portion of the roof frame structure, similar to the view of FIG. 3, illustrating another arrangement of the attachment of the lower portion of the slant toggle connector to the surface of the underlying wall.

FIG. 4 illustrates a variation of the attachment of the lower end of the slant toggle connector 30 to the surface 24 of the underlying wall 20 according to another embodiment of the present invention. The two metal bar sections of the lower portion 38 of the connector 30 are formed into another loop at a lower end 52 thereof, for example in a triangular shape. The looped end 52 provides a secure and convenient connection to a single metal strip such as a steel strip 54 with mounting holes (not indicated) therein. The single steel strip 54 extends through the looped lower end 52 and is folded to splay apart into two divergent paths (as shown), spreading downwardly across a substantial area of the surface 24 of the underlying wall 20, thereby providing increasing areas for secure anchorage to the surface 24 of the underlying wall by way of nails or screws (not shown).

Referring to FIGS. 1-4, under windstorm conditions, wind uplift forces represented by arrow 60 act upon and throughout the entire body of the roof frame 10 transferred into it, along its length by wind pressure differentials pushing up on the roof sheathing panel 22. Wind uplift forces 60 are not concentrated near the location where the slant toggle connector 30 is disposed, although the two-dimensional drawing makes it appear so. The wind uplift forces 60 are countered by restraining forces represented generally by arrow 62, which forces are provided by the slant toggle connector 30. Advantageously, local restraining forces applied by the pin 36 through the load distribution plate 44 to the roof frame 10 and represented by arrow 62*a*, form a loading compression downward across the wood grain through the greater part of the cross-section of the roof frame 10, thereby allowing a greater force to be exerted with no tensile components relative to the wood grain of the roof frame 10, and therefore there is no tendency to cause the wood to split and lose strength.

Nevertheless, due to the asymmetric stance of the slant toggle connector 30 relative to the roof frame 10, the local restraining forces 62*a* impart a twisting moment 64 to the roof frame 10 while generating the restraining forces 62 to hold down the roof frame 10. The twisting moment 64, however, is very small in relation to the restraint offered by the roof sheathing panel 22 against twisting of the roof frames 10, and the restraint offered by the wood blocking (not shown) that is often present atop the underlying wall 20 between roof frames.

The nature of the slant toggle connector 30 is to yield a little in taking upload from the roof frame 10 such that the existing fasteners such as steel strips or "toe-nails" in the roof frame structure can contribute to securing the roof frame 10 against wind uplift forces. In fact, it may be desirable to make the slant toggle connector 30 somewhat stiffer in performance. Such yielding effect of the slant toggle connector 30 generally results from localized wood deformation of the roof frame 10 at an entry 25 and the exit 27 of the hole 30 under compressive and contact stresses applied by the bend 40 of the connector 30 and the pin 36, respectively. The broken line (not indicated) at the entry 25 of the hole 30 in FIG. 2, illustrates the original profile of the entry 25 which has been deformed under the compressive and contacting stresses from the connector 30 into the profile indicated by the solid line, resulting in the yielding effect of the connector 30. A similar situation would occur at the exit 27 of the hole 30 if the first load distribution plate was not placed in position. Furthermore, teeth 48 of the load distribution plate 44 prevent slippage of the plate 44 on the first side 16 of the roof frame 10. Such a slippage of the plate 44 would also cause the yielding effect of the connector 30.

Therefore, it may sometimes be desirable to place a second load distribution plate which is not shown but can be similar to the plate 44, between the second side 18 of the roof frame 10 and the connector 30 at the entry 25 of the hole 26 in order to prevent or minimize the wood deformation of the roof frame 10 at the entry 25 of the hole 26.

It should be noted that an effective way of stiffening the slant toggle connector's retaining action is to pretension the connector 30 before securing the lower end thereof to the underlying wall 20. Manual prior art lever tools are available for such a pretensioning operation.

The slant toggle connector 30 is preferably fabricated entirely of highly corrosion-resistant metals such as zinc galvanized steel, or preferably stainless steel, particularly for applications in coastal regions.

In a generally described retrofit operation, a first step is to make the hole 26 extending slantingly upward through the roof frame 10 from the second side 18 to the first side 16 thereof. The second step is to insert the upper portion 32 of the slant toggle connector 30 through the hole 26 from the entry 25 thereof on the second side 18 to the exit 27 on the first side 16 of the roof frame 10, until the upper end 34 of the connector 30 protrudes from the first side 16 of the roof frame 10. A third step is to attach a head member to the upper end 34 of the connector 30 in order to prevent the roof frame 10 from moving upward relative to the connector 30 under an uplift force. The fourth step is to secure a lower end of the connector 30, which is the two divergently extending steel strips in this embodiment, to the underlying wall 20.

It is desirable to have the angle in an appropriate range so that the local restraining forces 62*a* are applied mostly vertically. Thus, in particular, the first step is preferably practiced by determining the location of the entry 25 of the hole 26, based on the pre-determined angle such that the exit 27 of the hole 26 at the first side 16 of the roof frame 10 is preferably located near a top edge 12 of the roof frame 10, allowing an adequate space under the roof sheathing panel 22 for the upper end 34 of the connector 30 to protrude from the exit 27 and allowing attachment of the connector head which is the pin 36 received in the looped upper end 34 of the connector 30. The entry 25 can be located in a position, preferably at a lower portion of the second side 18 of the roof frame 10.

It should be understood that the diameter of the hole 26 is slightly greater than the cross-sectional dimension of the connector 30 in order to allow the upper portion 32 of the connector 30 to extend therethrough.

It is preferable to attach the first load distribution plate 44 to the first side 16 of the roof frame 10 prior to the attachment of the connector head which is the pin 36 in this embodiment. The plate 44 is preferably positioned such that the slot 46 thereof is aligned with the exit 27 of the hole 26 to allow the upper end 34 of the connector 30 to extend therethrough. The attachment of the plate 44 to the roof frame 10 can be achieved by one hammer strike and then further secured to the roof frame 10 by pulling down the connector 30, for example in a pretensioning operation, to apply forces thereon. Optionally, the second load distribution plate can be attached in a similar manner.

It is also preferable to pretension the connector 30 after the attachment of the head member (pin 36 in this embodiment) and before securing the lower end of the connector 30 to the underlying wall 20.

The step of securing the lower end of the connector 30 is preferably practiced by securing the divergently extending metal strip sections to the underlying wall to increase a load bearing area of the wall.

Changes and modifications to the embodiments of the present invention described above may be made without departure from the spirit and the scope of the invention. For example, the connector 30 can be made of a single metal rod instead of the folded configuration. Such a single rod connector would require notching or threading at the upper end thereof to allow a slotted piece or threaded nuts to secure a washer or other load distribution plate thereto. Any other type of head member can be used to prevent the roof frame from moving upward relative to the connector under an uplift force, provided that such a head member can be relatively conveniently attached to the upper end of the connector by known fastening means. A head member can be integrated with a load distribution plate, such as a plate with a hook for engagement with the looped upper end. A single rod connector may include a single metal strip to be secured to the underlying wall or a plurality of metal strips which can be welded or otherwise connected to the lower end of the connector. The scope of the present invention is therefore intended to be limited solely by the scope of the appended claims.

The invention claimed is:

1. An apparatus for reinforcement of an existing roof frame structure, comprising:

an elongate connector having an upper portion slantingly extending upward through a hole through a roof frame, allowing an upper end of the connector to protrude from a first side of the roof frame near a top edge thereof, and allowing a lower portion of the connector to extend downwardly from a second side of the roof frame such that a lower end of the connector is secured to an immediately underlying supporting structure of the roof frame; and a head member detachably connected to the upper end of the connector in order to prevent the roof frame from moving upward relative to the connector under an uplift force.

2. The apparatus as claimed in claim 1 further comprising a load distribution plate adapted to be positioned between the head member and the first side of the roof frame, the plate having an opening to allow the connector to extend therethrough.

3. The apparatus as claimed in claim 2 wherein the load distribution plate comprises a plurality of teeth protruding from one side of the plate for penetrating into the roof frame.

4. The apparatus as claimed in claim 1 further comprising a strip connected to the lower end of the connector, adapted to be secured to a surface of the immediately underlying support structure.

5. The apparatus as claimed in claim 1 wherein the connector comprises a metal bar folded to form a loop at the upper end thereof.

6. The apparatus as claimed in claim 5 wherein the head member comprises a pin extending through the loop of the upper end of the connector.

7. The apparatus as claimed in claim 1 wherein the connector comprises a metal bar having a rectangular cross-section, the metal bar being folded at a middle point thereof to form the connector including the upper and lower portions thereof, a section of the metal bar at the middle point thereby forming the loop of the upper end of the connector.

8. A reinforced roof frame structure, comprising:

an elongate connector having an upper portion extending slantingly upward through a hole through a roof frame under a roof sheathing panel and a lower portion extending downwardly from a second side of the roof frame, the upper portion of the connector including an upper end thereof protruding from a first side of the roof frame near a top edge of the roof frame, and the lower portion of the connector including a lower end thereof secured to an underlying wall; and a head member detachably connected to the upper end of the connector in order to prevent the roof frame from moving upward relative to the connector under an uplift force.

9. The structure as claimed in claim 8 wherein the upper portion of the connector comprises a loop forming the upper end of the connector for receiving a pin extending through the loop to form the head member.

10. The structure as claimed in claim 8 wherein the flexible and elongate connector is pre-tensioned between the upper and lower ends thereof.

11. The structure as claimed in claim 8 further comprising a first load distribution plate disposed between the head member and the first side of the roof frame.

12. The structure as claimed in claim 8 further comprising a second load distribution plate disposed between the connector and the second side of the roof frame, and adjacent to the hole.

13. The structure as claimed in claim 8 wherein the lower end of the connector comprises means connected thereto and secured to the underlying wall, for increasing a connector anchorage area to the wall.

* * * * *